US006641457B1

(12) United States Patent
Lai

(10) Patent No.: US 6,641,457 B1
(45) Date of Patent: Nov. 4, 2003

(54) CHASSIS OF REMOTELY CONTROLLABLE CAR

(76) Inventor: Aling Lai, P.O. Box 2103, Taichung (TW)

( * ) Notice: Subject to any disclaimer, the term of this patent is extended or adjusted under 35 U.S.C. 154(b) by 0 days.

(21) Appl. No.: 10/201,034

(22) Filed: Jul. 23, 2002

(51) Int. Cl.[7] ..... A63H 17/00

(52) U.S. Cl. ..... 446/465; 446/470; 446/93; 446/431; 446/454

(58) Field of Search ..... 446/454, 456, 446/465, 466, 469, 470, 471, 437, 431, 93, 94, 95

(56) References Cited

U.S. PATENT DOCUMENTS 3,711,989 A * 1/1973 Nielsen et al. ..... 446/469
4,159,126 A * 6/1979 Raleigh ..... 446/466
4,406,085 A * 9/1983 Rhodes ..... 446/456
4,533,336 A * 8/1985 Dixon et al. ..... 446/465
4,764,150 A * 8/1988 Uchino ..... 446/456
4,799,915 A * 1/1989 Lehmann et al. ..... 446/456
5,338,247 A * 8/1994 Miles ..... 446/456
5,482,494 A * 1/1996 Ishimoto ..... 446/456
5,765,508 A * 6/1998 Markowitz ..... 446/456
5,785,576 A * 7/1998 Belton ..... 446/456
6,000,988 A * 12/1999 Tsai ..... 446/465

* cited by examiner

*Primary Examiner*—Derris H. Banks
*Assistant Examiner*—Urszula M Cegielnik

(57) ABSTRACT

A chassis of remotely controllable car, including an upper board and two side walls which are integrally formed. A lower board is connected under the bottoms of the side walls. The chassis is a frame body integrally formed by the upper board, the lower board and the two side walls. The engine, gear cases and wheels of the remotely controllable car are mounted on the chassis.

5 Claims, 6 Drawing Sheets

CHASSIS OF REMOTELY CONTROLLABLE CAR

BACKGROUND OF THE INVENTION

A present invention is related to a chassis of remotely controllable car, which is integrally formed to reinforce a car body. A engine, gear cases and other components of the remotely controllable car can be easily firmly mounted on the chassis.

FIG. 7 shows a conventional chassis structure of a remotely controllable car. The chassis 7 is made of an aluminum board by punching. On the chassis 7 are mounted an engine 71, a gear case 72, a fuel tank 73, a rocking arm 75, etc. In addition, the chassis 7 must be able to bear impact. Therefore, the chassis 7 is required to have sufficient rigidity and permit the above components to be easily mounted thereon. However, the conventional chassis of the remotely controllable car is a plat board which has insufficient rigidity and is easy to permanently deform when the car body suffers an impact.

When the car runs on an irregular road face and suffers shocking force, the chassis 7 tends to bend and deform. This will affect the stability of the remotely controllable car and lead to damage of the car.

The front and rear wheels 74 are mounted on the front and rear end boards 76, 77 of the chassis 7. In order to reserve a vertically moving space for the rocking arms 75, the front and rear end boards 76, 77 are tapered toward the middle of the chassis 7. Accordingly, the area of the front and rear end boards 76, 77 are tapered and the rigidity of the chassis 7 as a whole is reduced. However, the front and rear end boards 76, 77 suffer most of the impact coming from the wheels 74. Therefore, the chassis 7 is easier to deform when suffering an impact.

Moreover, the bottoms of the engine 71 and the other components are directly locked on the flat chassis 7 without other reinforcing or fixing structure. Therefore, when the remotely controllable car runs and shakes, the engine 71 and the other components tend to loosen or even detach due to shock. This will make it impossible to further operate the car.

FIG. 8 shows another kind of chassis structure of the conventional remotely controllable car. In order to eliminate the above shortcomings, several support posts 92 are screwed on the chassis 8. A second floorboard 9 is fixed on the support posts 92 by screws. The second floorboard 9 is formed with several holes 91 in which the engine 81, fuel tank 83, etc. are accommodated. The engine 81, etc. are more firmly fixed on the chassis 8 and the second floorboard 9 by screws. Several connecting rods 93 are connected between the second floorboard 9 and the front and rear gear cases 82 for reinforcing the structural strength of the chassis The second floorboard 9 is not integrally formed with the chassis 8 and is fixed on the chassis 8 via the support posts 92. Therefore, the rigidity of the chassis 8 is still limited. When suffering an impact, the sections of the chassis 8 and the second floorboard 9 between the support posts 92 are still easy to deform. In addition, the second floorboard 9 is connected with the front and rear gear cases 82 via the connecting rods 93. The front and rear gear cases 82 bear most of the impact, coming from the wheels 84. Therefore, simply by means of the connecting rods 93, the chassis, 8 is still not provided with sufficient rigidity for resisting against the impact.

Furthermore, the front and rear wheels 84 are mounted on the front and rear end boards 86, 87 of the chassis 8 with the second floorboard 9. Still in order to reserve a vertically moving space for the rocking arms 85, the front and rear end boards 86, 87 are tapered toward the middle of the chassis 8. Accordingly, the area of the front and rear end boards 86, 87 are tapered and the rigidity of the chassis 8 as a whole is reduced. However, the front and rear gear cases 82 are mounted on the front and rear end boards 86, 87 which suffer most of the impact coming from the front and rear wheels 84. Therefore, the chassis 8 is still easy to deform when suffering the impact.

Moreover, it is necessary additionally manufacture the second floorboard 9 in accordance with the shape of the chassis 8 and the positions of the engine 81 and other components. Then the second floorboard 9 is assembled with the chassis 8 via the support posts 92 and the connecting rods 93. Then the engine 81, fuel tank 83, etc. are mounted on the chassis 8 and the second floorboard 9. Accordingly, the manufacturing and assembling procedures are complicated and the cost is increased.

SUMMARY OF THE INVENTION

It is therefore a primary object of the present invention to provide a chassis of remotely controllable car. The chassis is a frame body integrally formed by an upper board, a lower board and two side walls. By means of the chassis, the rigidity of the car body is increased and the car body has better anti-collision ability and torque strength.

It is a further object of the present invention to provide the above chassis in which the side walls respectively downward extend from two sides of the upper board. Therefore, the upper board is positioned in a higher position and the engine, gear cases and fuel tank of the remotely controllable car can be directly fixedly accommodated in the upper board. Accordingly, the second floorboard is no more necessary so that the manufacturing and assembling procedures are simplified and the cost is lowered.

It is still a further object of the present invention to provide the above chassis in which the engine, gear cases and fuel tank of the remotely controllable car under the upper board are protected by the side walls so that the using life of the remotely controllable car is prolonged.

The present invention can be best understood through the following description and accompanying drawings wherein:

DETAILED DESCRIPTION OF THE PREFERRED EMBODIMENTS

Figure 1:
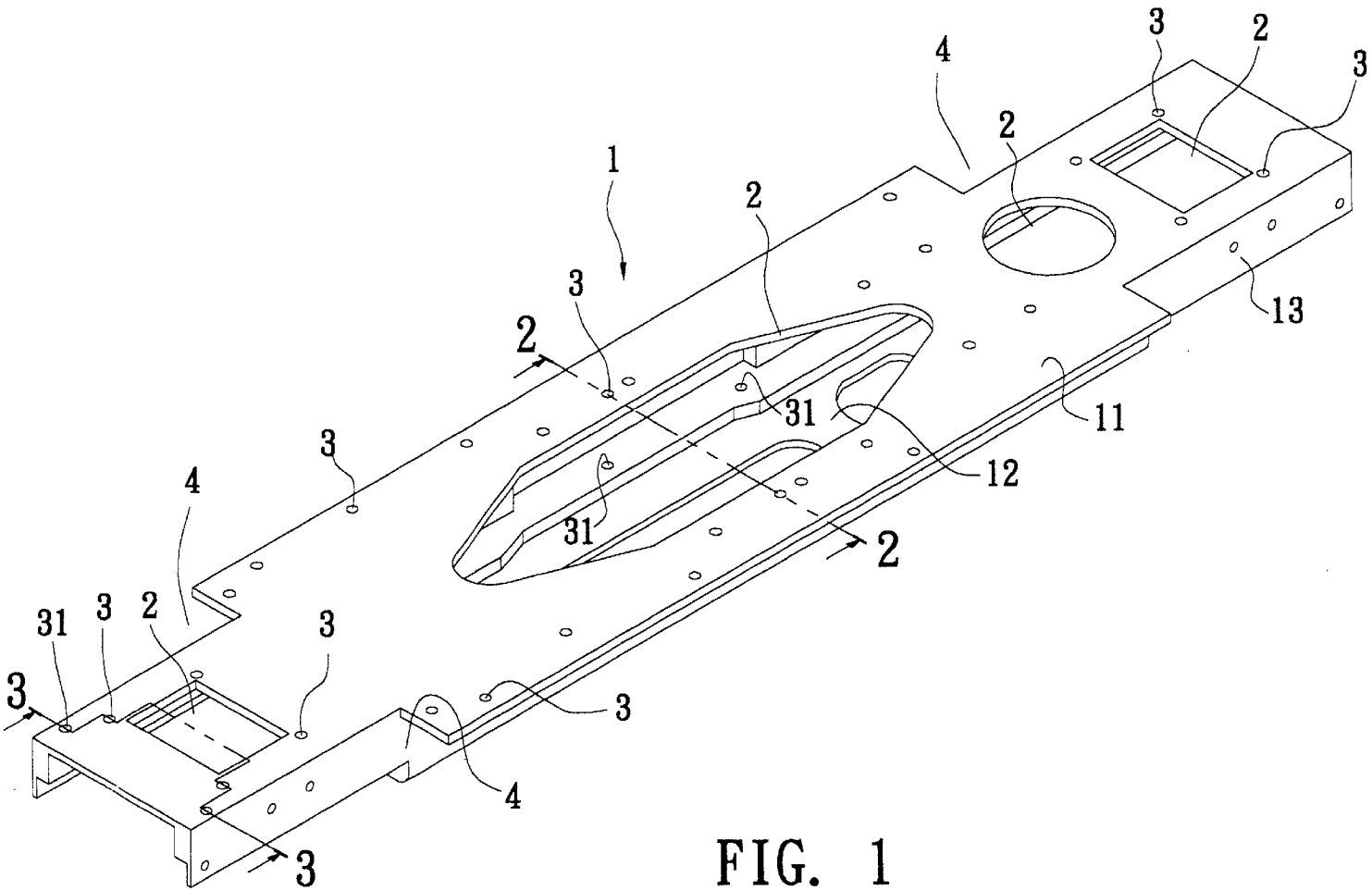
FIG. 1 is a perspective view of the present invention.
Figure 3:
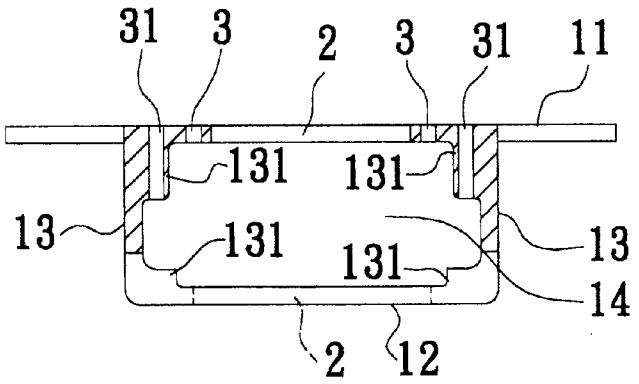
FIG. 3 is a sectional view taken along line 3—3 of FIG. 1.
Figure 2:
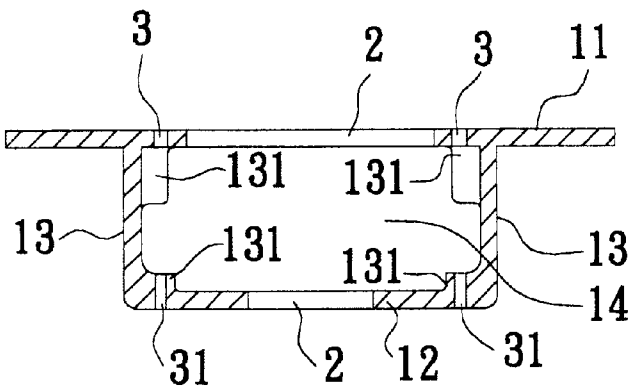
FIG. 2 is a sectional view taken along line 2—2 of FIG. 1.

Please refer to FIGS. 1 to 3. The chassis 1 of the remotely controllable car of the present invention is integrally formed.

The chassis 1 includes an upper board 11 and a lower board 12. Two sides of the lower board 12 respectively have two side walls 13 upward extending to and connecting with the upper board 11. The upper board 11, the lower board 12 and the two side walls 13 define therebetween a receiving space 14. The upper and lower boards 11, 12 are formed with several openings 2 in which the engine 5, gear cases 51, etc. of the remotely controllable car are accommodated. The upper and lower boards 11, 12 are further formed with several circular apertures 3 for bolts to pass therethrough. Two sides of each of the front and rear ends of the upper board 11 are respectively formed with two recesses 4. The side walls 13 respectively have reinforcing ribs 131 connected between the upper and lower boards 11, 12. The reinforcing ribs 131 have a certain thickness for increasing the strength of the side walls 13 and the upper and lower boards 11, 12. Each reinforcing rib 131 is formed with several axial through holes 31 with a certain depth.

Figure 4:
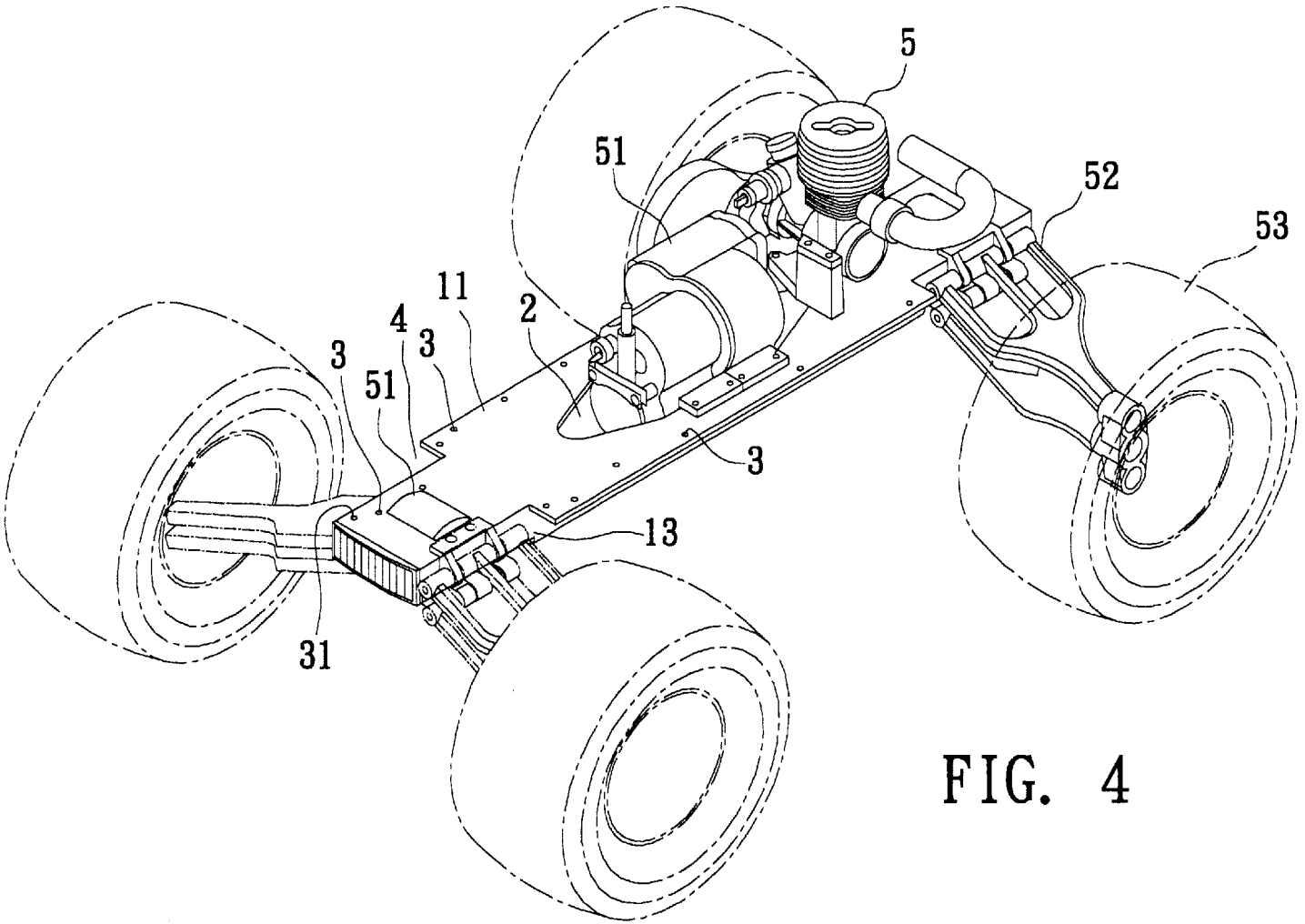
FIG. 4 shows the application of the present invention.

In use, as shown in FIG. 4, the engine 5 and several gear cases 51 are accommodated in the recesses 4. The gear cases 51 are respectively mounted through the recesses 4 in the receiving space 14. By means of screws passing through the corresponding circular apertures 3 or through holes 31, the engine 5 and gear cases 51 are firmly fixed and protected by the lower board 12 and the two side walls 13 from being collided and damaged. Then the rocking arms 52 of the wheels 53 are respectively mounted on the side walls 13 in the recess 4 of the upper board 11. By means of the recesses 4, the operation of the rocking arms 52 will not be obstructed.

Figure 5:
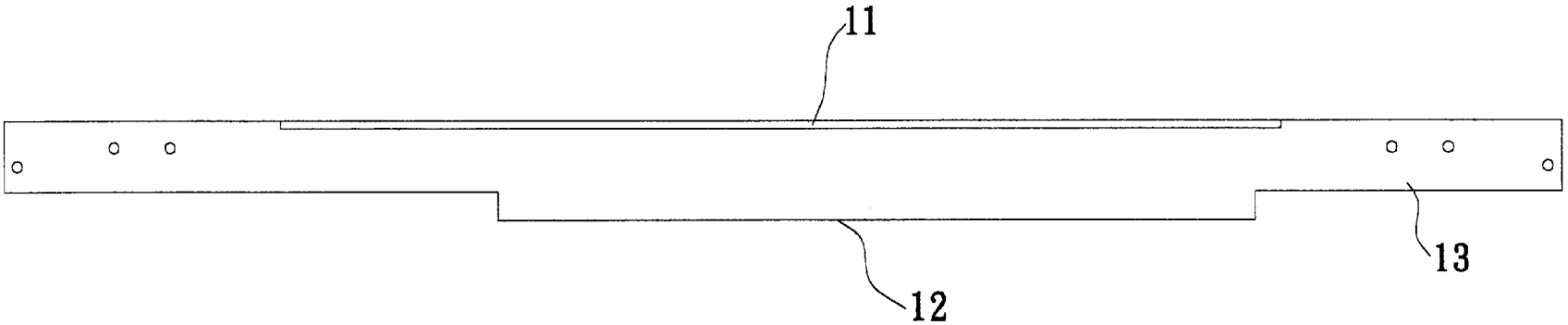
FIG. 5 is a side view of the present invention.

The chassis 1 is a frame body integrally formed by the upper board 11, lower board 12 and the two side walls 13. As shown in FIG. 5, the side walls 13 serve as vertical supporting faces, whereby the rigidity of the chassis 1 is increased so that the chassis 1 is able to bear universal impacting force. Accordingly, the chassis 1 has better anti-collision ability and torque strength.

Furthermore, the gear cases 51 are disposed between the side walls 13 of the chassis 1 and protected thereby. The rocking arms 52 of the wheels 53 are respectively mounted on the side walls 13 in the recesses 4 of the upper board 11. Although two sides of each of the front and rear ends of the upper board 11 are respectively formed with the recesses 4, the side walls 13 serving as vertical supporting faces enable the chassis 1 to bear the violent shock coming from the wheels 53. Therefore, the chassis 1 will not be deformed and the remotely controllable car is more durable.

Figure 6:
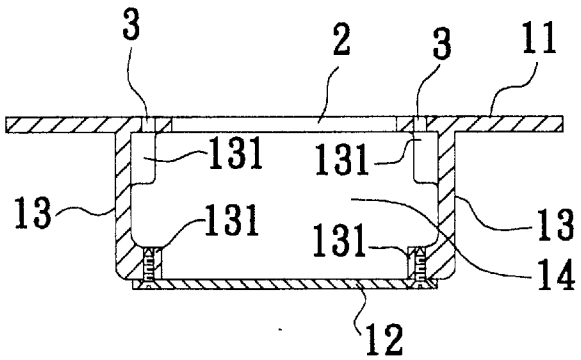
FIG. 6 is a sectional view of a second embodiment of the present invention, in which the lower board is fixed under the bottoms of the side walls by screws.
Figure 7:
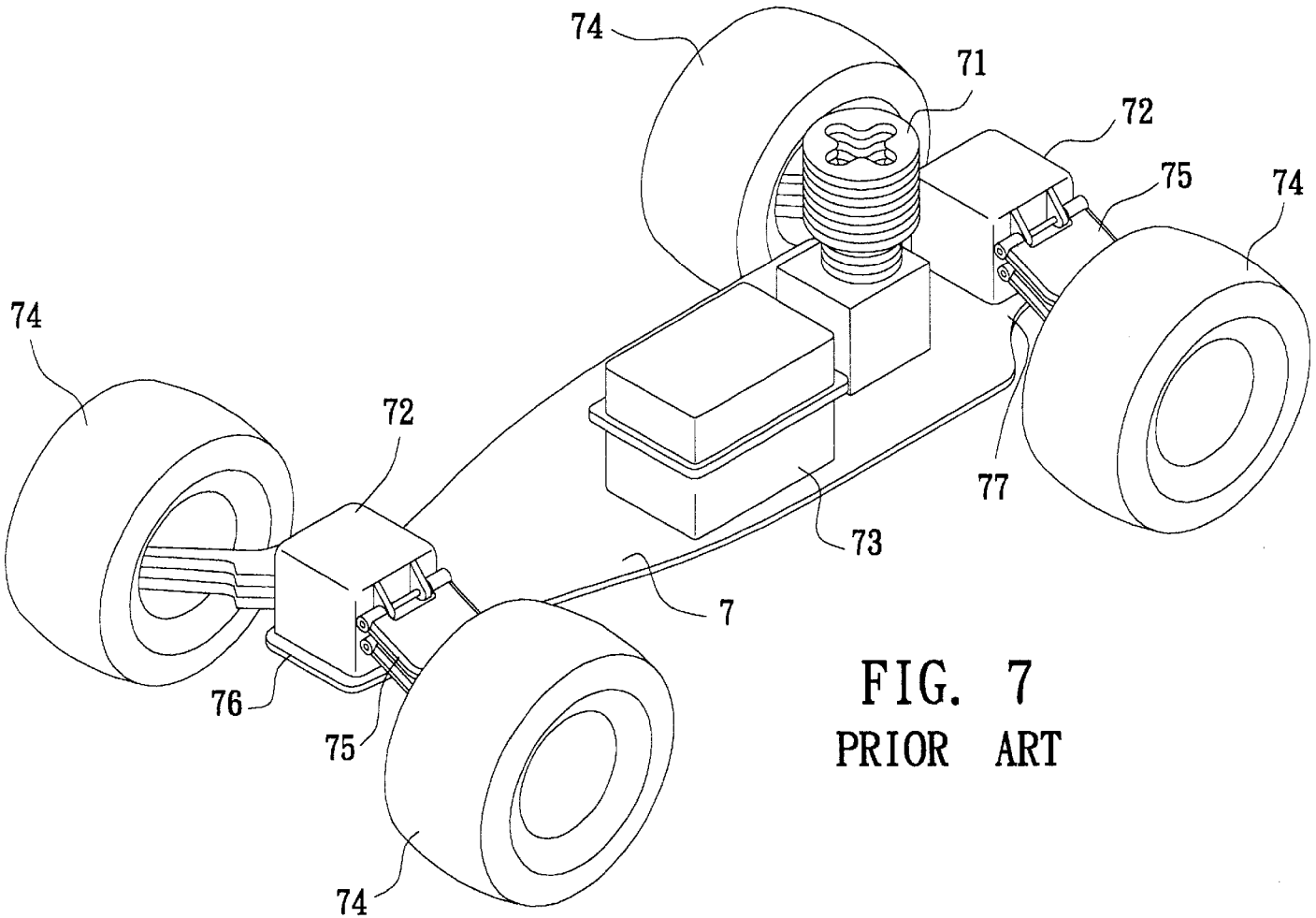
FIG. 7 PRIOR ART
FIG. 7 is a perspective view of a conventional chassis of remotely controllable car.
Figure 8:
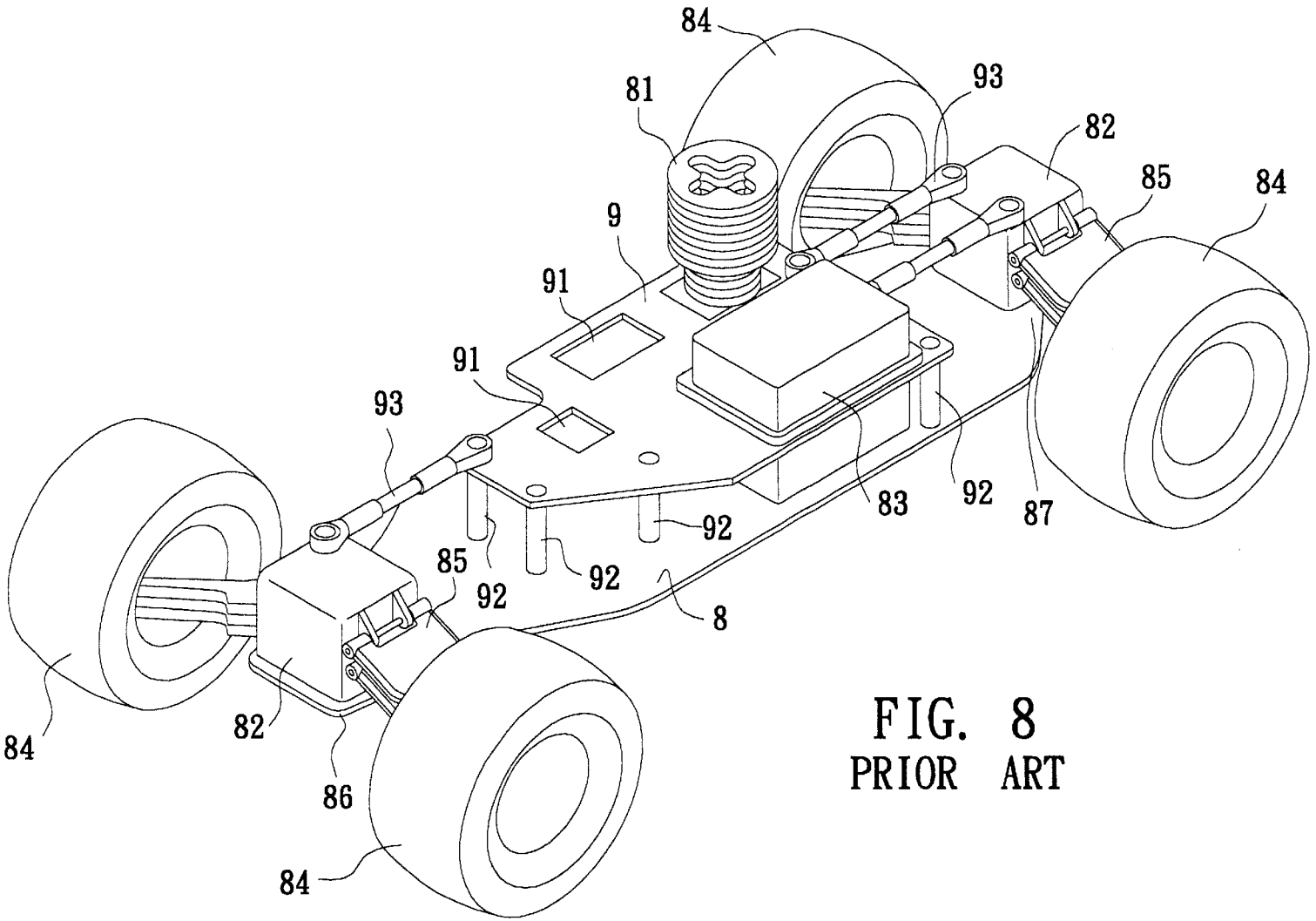
FIG. 8 PRIOR ART
FIG. 8 is a perspective view of another type of conventional chassis of remotely controllable car.

FIG. 6 shows a second embodiment of the present invention, in which the lower board 12 can be fixed under the bottoms of the side walls 13 by screws. This also increases the rigidity of the chassis 1 and prevents the chassis 1 from easily deforming.

The above embodiments are only used to illustrate the present invention, not intended to limit the scope thereof. Many modifications of the above embodiments can be made without departing from the spirit of the present invention.

What is claimed is:

1. A chassis of a remotely controllable car, comprising an upper board and two side walls which are integrally formed with the upper board, the two side walls respectively downward extending from two opposite sides of a bottom of the upper board, a lower board being connected under a bottom of each of the two side walls, the upper and lower boards and the two side walls defining a receiving space between the upper board, the lower board and the two side walls, the upper board is formed with multiple openings, circular apertures and through holes, the two side walls respectively having reinforcing ribs connected between the upper and lower boards, the reinforcing ribs having a certain thickness.

2. The chassis of a remotely controllable car as claimed in claim 1, wherein the lower board is integrally formed with the bottom of each of the two side walls.

3. The chassis of a remotely controllable car as claimed in claim 1, wherein the lower board is fixed under the bottom of each of the two side walls by screws.

4. The chassis of a remotely controllable car as claimed in claim 1, wherein the two side walls vertically extend to connect the upper board with the lower boar.

5. The chassis of a remotely controllable car as claimed in claim 1, wherein each of the front and rear ends of the upper board has two opposite sides each formed with a recess.

* * * * *